US012522456B2

(12) United States Patent
Namiki et al.

(10) Patent No.: US 12,522,456 B2
(45) Date of Patent: Jan. 13, 2026

(54) MEDIUM TRANSPORT DEVICE AND IMAGE READING DEVICE

(71) Applicant: SEIKO EPSON CORPORATION, Tokyo (JP)

(72) Inventors: Masaki Namiki, Kitakyushu (JP); Kendai Kawakami, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 50 days.

(21) Appl. No.: 18/435,462

(22) Filed: Feb. 7, 2024

(65) Prior Publication Data

US 2024/0270525 A1 Aug. 15, 2024

(30) Foreign Application Priority Data

Feb. 10, 2023 (JP) ..... 2023-018870

(51) Int. Cl.
*B65H 3/52* (2006.01)
*B65H 3/06* (2006.01)
*B65H 5/06* (2006.01)

(52) U.S. Cl.
CPC ..... *B65H 5/062* (2013.01); *B65H 3/06* (2013.01); *B65H 2301/544* (2013.01); *B65H 2404/1451* (2013.01); *B65H 2557/25* (2013.01)

(58) Field of Classification Search
CPC .. B65H 3/5261; B65H 3/5284; B65H 3/5246; B65H 3/5253; B65H 3/5276; B65H 3/0669; B65H 2511/224; B65H 2511/13; B65H 2404/1451
See application file for complete search history.

(56) References Cited

U.S. PATENT DOCUMENTS

2019/0193967 A1 6/2019 Shuto
2020/0299088 A1* 9/2020 Umi ..... B65H 3/5284

FOREIGN PATENT DOCUMENTS

JP 2003221140 A * 8/2003
JP 2019-116383 A 7/2019

* cited by examiner

*Primary Examiner* — Luis A Gonzalez
(74) *Attorney, Agent, or Firm* — WORKMAN NYDEGGER

(57) ABSTRACT

A medium transport device includes: a feeding roller that feeds a medium mounted on a medium mounting section; a separation roller that nips the medium with the feeding roller to separate the medium and is configured to rotate in a first rotation direction in which the medium is transported downstream and a second rotation direction that is opposite to the first rotation direction; a pressing member that presses the separation roller against the feeding roller; a pressing force change portion that changes a pressing force of the pressing member; and a single drive source that generates a driving force for the separation roller and a driving force for the pressing force change portion.

13 Claims, 10 Drawing Sheets

MEDIUM TRANSPORT DEVICE AND IMAGE READING DEVICE

The present application is based on, and claims priority from JP Application Serial Number 2023-018870, filed Feb. 10, 2023, the disclosure of which is hereby incorporated by reference herein in its entirety.

BACKGROUND

1. Technical Field

The present disclosure relates to a medium transport device and an image reading device.

2. Related Art

JP-A-2019-116383 describes an example of these types of devices. JP-A-2019-116383 discloses that each of a first drive source 25 that drives a separation roller 15 and a load change unit 120 is provided with the intention of achieving suitable separation of various types of media from thin paper to thick paper with the separation roller. The load change unit 120 changes a pressing load of the separation roller 15 on a feeding roller 14 by switching a switching gear 125 between a first position M1 and a second position M2 (Paragraph 0129).

However, in JP-A-2019-116383, there is room for improvement in the drive source that drives the separation roller and a portion of the drive source that changes the pressing load of the separation roller on the feeding roller 14 in terms of promoting device size reduction.

SUMMARY

According to an aspect of the present disclosure, a medium transport device includes: a feeding roller that feeds a medium mounted on a medium mounting section; a separation roller that nips the medium with the feeding roller to separate the medium and is configured to rotate in a first rotation direction in which the medium is transported downstream and a second rotation direction that is opposite to the first rotation direction; a pressing member that presses the separation roller against the feeding roller; a pressing force change portion that changes a pressing force of the pressing member; and a single drive source that generates a driving force for the separation roller and a driving force for the pressing force change portion.

According to an aspect of the present disclosure, an image reading device includes: the medium transport device according to the above-described aspect; and a reading portion that reads an image on the medium.

DESCRIPTION OF EMBODIMENTS

Figure 1:
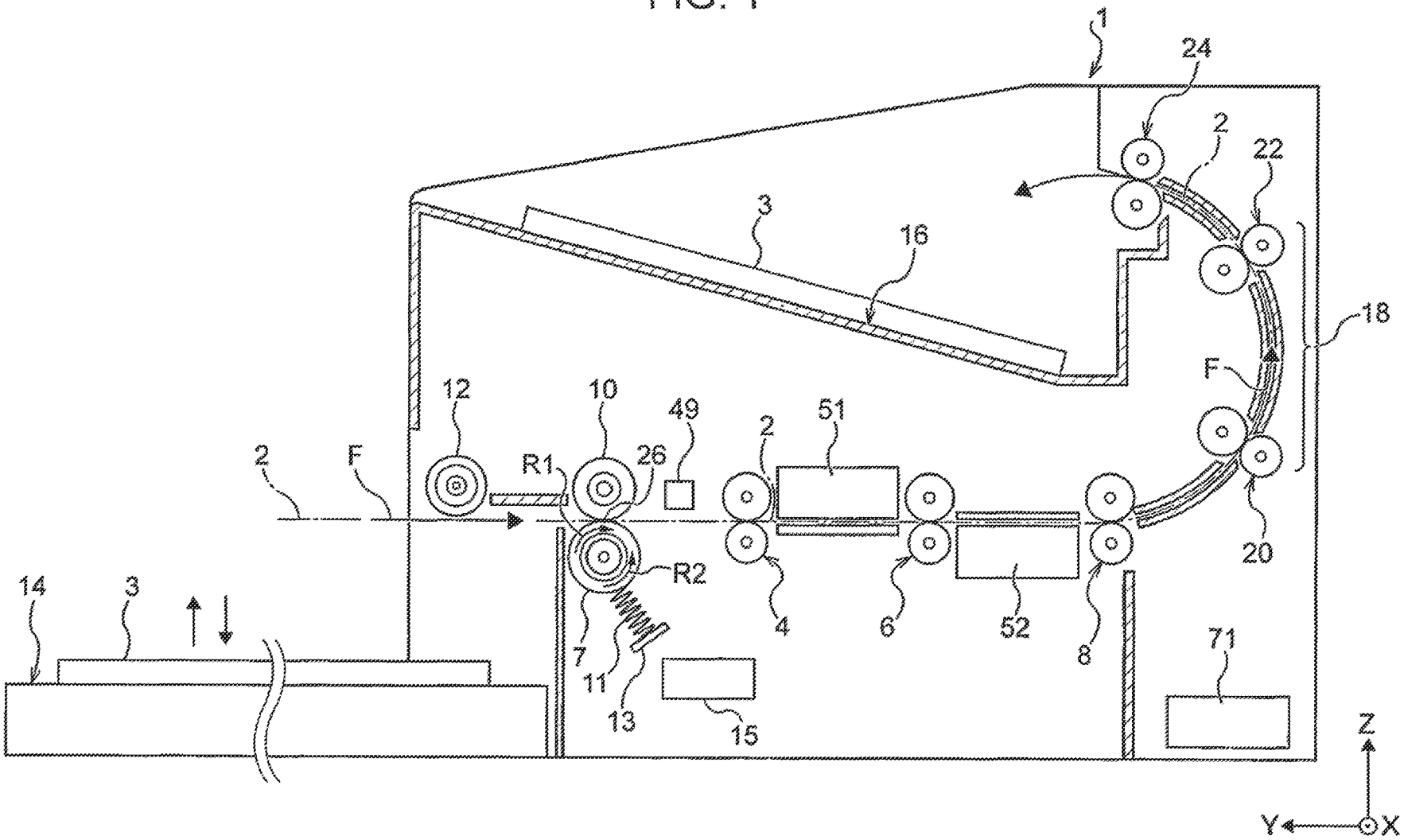
FIG. 1 is a diagram illustrating an internal configuration of an image reading device according to a first embodiment.

Hereinafter, the present disclosure will be schematically described first. According to a first aspect of the present disclosure, a medium transport device includes: a feeding roller that feeds a medium mounted on a medium mounting section; a separation roller that nips the medium with the feeding roller to separate the medium and is configured to rotate in a first rotation direction in which the medium is transported downstream and a second rotation direction that is opposite to the first rotation direction; a pressing member that presses the separation roller against the feeding roller; a pressing force change portion that changes a pressing force of the pressing member; and a single drive source that generates a driving force for the separation roller and a driving force for the pressing force change portion. Here, the "driving force for the separation roller" in "a single drive source that generates a driving force for the separation roller and a driving force for the pressing force change portion" means power for rotating the separation roller, and the "driving force for the pressing force change portion" means power for operating the pressing force change portion to change the pressing force of the pressing member.

According to this aspect, the pressing member that presses the separation roller against the feeding roller, the pressing force change portion that changes the pressing force of the pressing member, and the single drive source that generates the driving force for the separation roller and the driving force for the pressing force change portion are provided. As a result, the driving forces for driving the separation roller and the pressing force change portion are transmitted by the common drive source, that is, only one drive source is required, and thus, a reduction in the size of the device that transports media having different properties such as the thicknesses can be easily promoted.

According to a second aspect of the present disclosure, in the medium transport device according to the first aspect, the pressing force change portion includes a pressing portion that presses the pressing member, and changes a pressing load with which the pressing portion presses the pressing member to change the pressing force of the pressing member.

According to this aspect, the pressing force change portion changes the pressing load with which the pressing portion presses the pressing member to change the pressing force of the pressing member. Thereby, the pressing force of the pressing member can be changed with a simple structure.

According to a third aspect of the present disclosure, in the medium transport device according to the second aspect, the pressing force change portion includes an elongated body that includes the pressing portion and is configured to rotate around an axis, a power transmitted gear which is fixed to the elongated body and to which power of the drive source is transmitted, and a base portion that holds a base end of the pressing member and is configured to be displaced in a direction of the pressing force, and the base portion changes the pressing load by being displaced by a torque of the drive source transmitted via the power transmitted gear, the elongated body, and the pressing portion.

According to this aspect, the pressing force change portion includes the base portion that holds the base end of the pressing member and is configured to be displaced in the direction of the pressing force, and the base portion changes the pressing load that presses the pressing member by being displaced by the torque of the drive source transmitted via the power transmitted gear, the elongated body, and the pressing portion. Thereby, a change of the pressing load by the pressing force change portion can be implemented with a simple structure.

According to a fourth aspect of the present disclosure, in the medium transport device according to any one of the first to third aspects, a one-way clutch is provided on a transmission path through which the driving force is transmitted from the drive source to the pressing force change portion, and the drive source transmits, via the one-way clutch, the driving force for rotating the separation roller in the second rotation direction when rotating forward, and transmits the driving force for changing the pressing force to the pressing force change portion when rotating in reverse.

According to this aspect, the drive source transmits, via the one-way clutch, the driving force for rotating the separation roller in the second rotation direction when rotating forward, and transmits the driving force for changing the pressing force to the pressing force change portion when rotating in reverse. Thereby, a state in which the driving force of the drive source is transmitted to the pressing force change portion can be easily implemented by switching the forward rotation of the drive source to the reverse rotation. That is, the pressing force of the pressing member can be easily changed by simply switching the forward rotation of the drive source to the reverse rotation. Furthermore, since the one-way clutch is provided, when the rotation of the drive source is changed to the forward rotation, the driving force is not transmitted to the pressing force change portion. That is, the state of the pressing force change portion is maintained as it is, and therefore the changed pressing force of the pressing member is maintained.

According to a fifth aspect of the present disclosure, in the medium transport device according to the fourth aspect, the separation roller is configured to perform switching between a driving force transmission state in which the driving force is transmitted from the drive source, and a driving force non-transmission state in which the driving force is not transmitted, and the driving force transmission state of the separation roller is switched to the driving force non-transmission state when the drive source rotates in reverse.

According to this aspect, the driving force transmission state of the separation roller is switched to the driving force non-transmission state when the drive source rotates in reverse. Therefore, it is possible to use the separation roller in a state in which the driving force is not transmitted, that is, in a state in which the driving force is not transmitted and the separation roller is free to rotate. Specifically, it is possible to easily implement medium feeding in a so-called "manual feeding mode" in which the user feeds the media one by one, that is, there is no need for separation processing.

According to a sixth aspect of the present disclosure, the medium transport device according to any one of the first to fifth aspects further includes: a thickness detection unit that detects a thickness of the medium; and a control unit, in which the control unit drives the pressing force change portion to change the pressing force of the pressing member based on a detection result of the thickness detection unit.

According to this aspect, the control unit drives the pressing force change portion to change the pressing force of the pressing member based on the detection result of the thickness detection unit. Therefore, it is possible to automatically change the pressing force of the pressing member according to the thickness of the medium.

According to a seventh aspect of the present disclosure, in the medium transport device according to the sixth aspect, the thickness detection unit is provided downstream of the feeding roller in a transport direction, and the control unit causes the feeding roller to feed the medium to transport the medium to a detection position where the thickness of the medium is detectable by the thickness detection unit, and causes the thickness detection unit to detect the thickness of the medium in a state in which the medium is stopped at the detection position.

According to this aspect, the control unit causes the feeding roller to transport the medium to the thickness detection position for the thickness detection unit, and causes the thickness detection unit to detect the thickness of the medium in a state in which the medium is stopped at the detection position. Thereby, it is possible to detect the thickness of the medium with higher accuracy.

According to an eighth aspect of the present disclosure, the medium transport device according to any one of the first to seventh aspects further includes a control unit that receives information (type or thickness) regarding the medium from the user, in which the control unit drives the pressing force change portion to change the pressing force of the pressing member based on the information regarding the medium.

According to this aspect, the control unit drives the pressing force change portion to change the pressing force of the pressing member based on the information regarding the medium received from the user, such as the type or thickness of the medium. Thereby, it is possible to drive the pressing force change portion to change the pressing force of the pressing member based on the information regarding the medium input from the user without a unit that detects the thickness of the medium.

According to a ninth aspect of the present disclosure, the medium transport device according to any one of the first to eighth aspects further includes a control unit that drives the pressing force change portion to change the pressing force of the pressing member, in which the control unit changes the pressing force of the pressing member and changes a rotation speed of the separation roller.

According to this aspect, the control unit changes the pressing force of the pressing member and changes the rotation speed of the separation roller. Thereby, it is possible to perform more appropriate separation by changing the rotation speed of the separation roller according to the medium.

According to an aspect of the present disclosure, an image reading device includes: the medium transport device according to any one of the first to ninth aspects; and a reading portion that reads an image on the medium. According to this aspect, the effects of the aspects of the medium transport device can be obtained with the image reading device.

EMBODIMENTS

Hereinafter, embodiments of a medium transport device according to the present disclosure and an image reading device including the medium transport device will be specifically described with reference to the drawings. In the following description, three mutually orthogonal axes are referred to as an X axis, a Y axis, and a Z axis, respectively, as illustrated in each drawing. Directions indicated by arrows of the three axes (X, Y, and Z) are + directions, and directions opposite thereto are − directions. A Z-axis direction corresponds to a vertical direction, that is, a direction in which gravity acts, a +Z direction indicates a vertically upward direction, and a −Z direction indicates a vertically downward direction. An X-axis direction and a Y-axis direction correspond to a horizontal direction. A +Y direction indicates a front direction of the device, and a −Y direction indicates a rear direction of the device. A +X direction indicates a right direction of the device, and a −X direction indicates a left direction of the device.

First Embodiment

Image Reading Device

An image reading device 1 according to the present embodiment is a scanner that can read an image on a medium. Here, the image means something visually recorded on the medium, such as characters, figures, tables, pictures, photographs, or the like. The medium is not limited to a sheet and also includes a card, a booklet, or the like. As illustrated in FIG. 1, the image reading device 1 includes reading portions 51 and 52 that read an image on a medium 3, a first transport roller 4 that transports the medium 3 in a transport direction F along a transport path 2 and is provided upstream of the reading portion 51, a second transport roller 6 that is provided upstream of the other reading portion 52 positioned downstream of the reading portion 51, and a third transport roller 8 that is provided downstream of the reading portion 52. A roller pair including a feeding roller 10 and a separation roller 7 is arranged upstream of the first transport roller 4 in the transport direction F. The feeding roller 10 is a drive roller that rotates by power of a drive source (not illustrated), and transports the medium 3 in the transport direction F. The separation roller 7 is a drive roller that rotates by power of a drive source 15 described below, and is a roller that separates a single medium from a plurality of media 3. Here, a retard roller is used as the separation roller 7. The separation roller 7 rotates by the power of the drive source 15 in a second rotation direction R2 in which the medium 3 is transported upstream in the transport direction F. The separation roller 7 includes a torque limiter (not illustrated). When the separated medium 3 is transported, a torque exceeding a set value is applied to the torque limiter, and the separation roller 7 accordingly rotates in a first rotation direction R1 in which the medium 3 is transported downstream in the transport direction F. A pick roller 12 is arranged upstream of the separation roller 7. The pick roller 12 is a drive roller that rotates by the power of the same drive source as that for the feeding roller 10, and transports the medium 3 in the transport direction F. In the present embodiment, a curved reversing path 18 is provided downstream of the third transport roller 8. A fourth transport roller 20, a fifth transport roller 22, and a discharge roller 24 are arranged on the curved reversing path 18 in this order in the transport direction F.

In FIG. 1, Reference Numeral 14 denotes a medium mounting section for setting the medium 3 to be read, and Reference Numeral 16 denotes a discharge receiving section to which the read medium 3 is discharged. The medium mounting section 14 is configured to move up and down. When transporting the medium 3 set on the medium mounting section 14 in the transport direction F, the medium mounting section 14 first moves upward (+Z direction) and stops in a state in which the uppermost medium 3 among the set media 3 is in contact with the pick roller 12. As the pick roller 12 rotates in this state, the medium 3 is transported in the transport direction F, and a leading edge of the medium 3 reaches a nip position 26 of the roller pair including the feeding roller 10 and the separation roller 7.

In a multi-feed state in which a plurality of media 3 are fed, the separation roller 7 separates one medium 3 from the media 3, the one medium 3 is transported in the transport direction F by the first transport roller 4, and the reading portion 51 reads an image on a first side of the medium 3. Furthermore, the medium 3 read by the reading portion 51 is transported by the second transport roller 6, and the reading portion 52 reads an image on a second side of the medium 3 opposite to the first side. The medium 3 read by the reading portion 52 is transported to the curved reversing path 18 by the third transport roller 8, transported by the fourth transport roller 20 and fifth transport roller 22, and then discharged to the discharge receiving section 16 by the discharge roller 24.

Medium Transport Device

In the present embodiment, the image reading device 1 includes a medium transport device 9. A structure of the medium transport device 9 will be described below with reference to FIGS. 1 to 8C. As illustrated in FIG. 1, the medium transport device 9 includes the feeding roller 10 that feeds the medium 3 mounted on the medium mounting section 14 and the separation roller 7 that nips the medium 3 with the feeding roller 10 to separate the medium 3. The separation roller 7 is a retard roller as described above, and is rotatable in the first rotation direction R1 in which the medium 3 is transported downstream in the transport direction F and the second rotation direction R2 that is opposite to the first rotation direction R1. Furthermore, the medium transport device 9 includes a pressing member 11 that generates a pressing force P (FIGS. 8A to 8C) for pressing the separation roller 7 against the feeding roller 10, a pressing force change portion 13 that changes the pressing force P of the pressing member 11, and the single drive source 15 that generates a driving force for the separation roller 7 and a driving force for the pressing force change portion 13. Here, the driving force for the separation roller 7 means power for rotating the separation roller 7, and the driving force for the pressing force change portion 13 means power for operating the pressing force change portion 13 to change the pressing force P of the pressing member 11. The driving forces are transmitted from the single drive source 15. Next, a power transmission path from the drive source 15 to the separation roller 7 and a power transmission path from the drive source 15 to the pressing force change portion 13 will be described.

Power Transmission Path from Drive Source to Separation Roller

Figure 2:
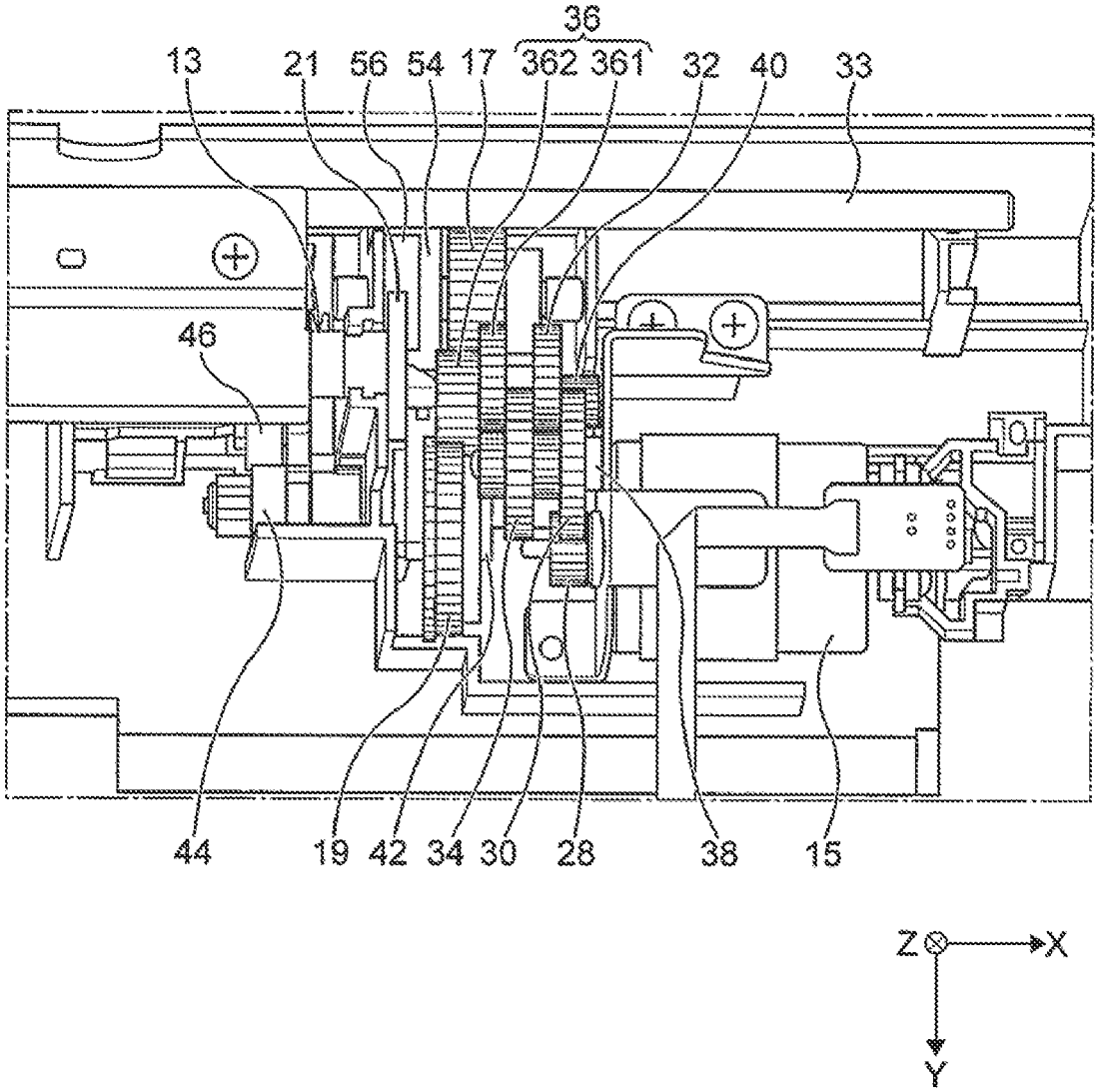
FIG. 2 is a plan view illustrating a main part of a power transmission path according to the first embodiment.
Figure 3:
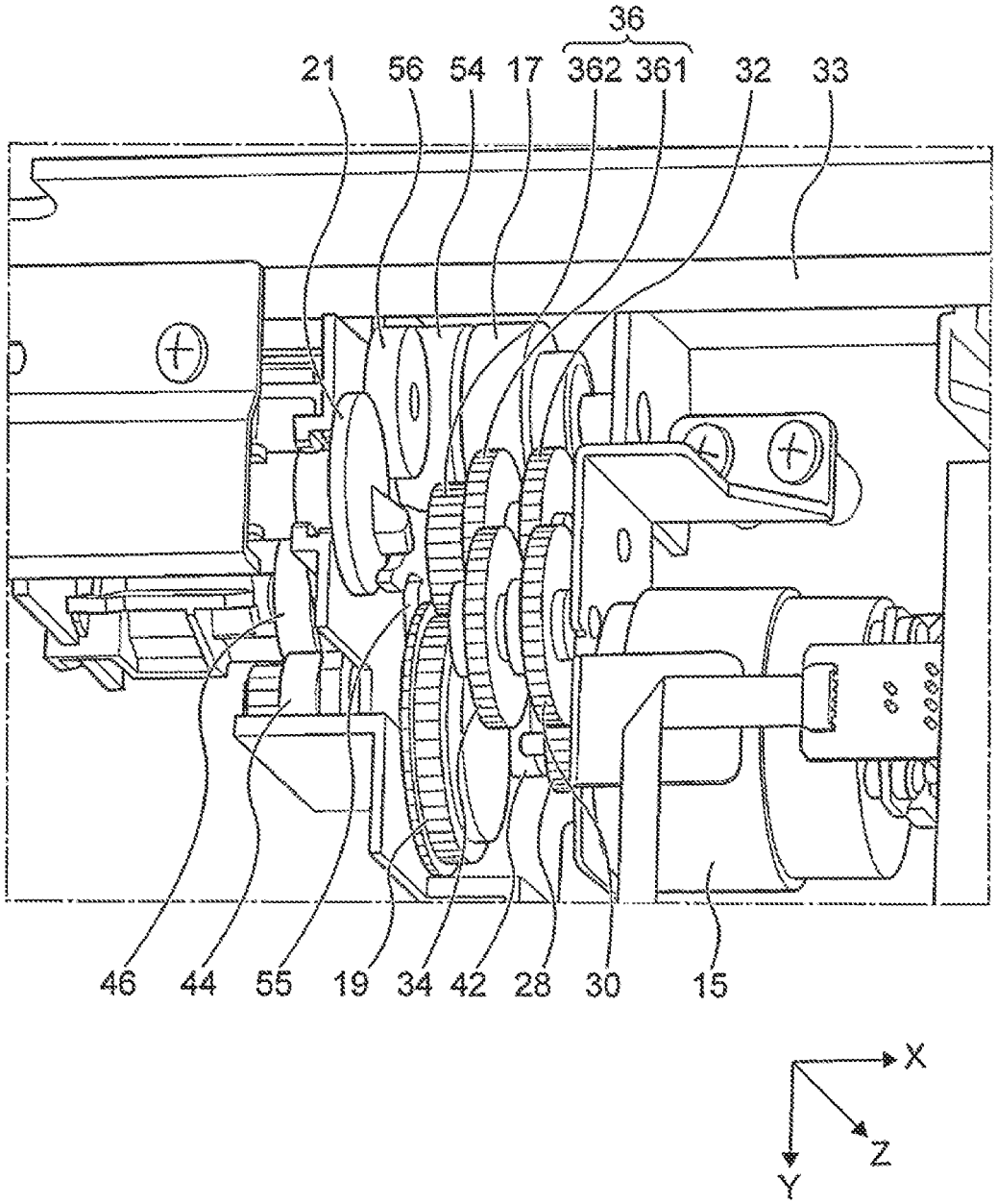
FIG. 3 is a perspective view illustrating the main part of the power transmission path according to the first embodiment.
Figure 4:
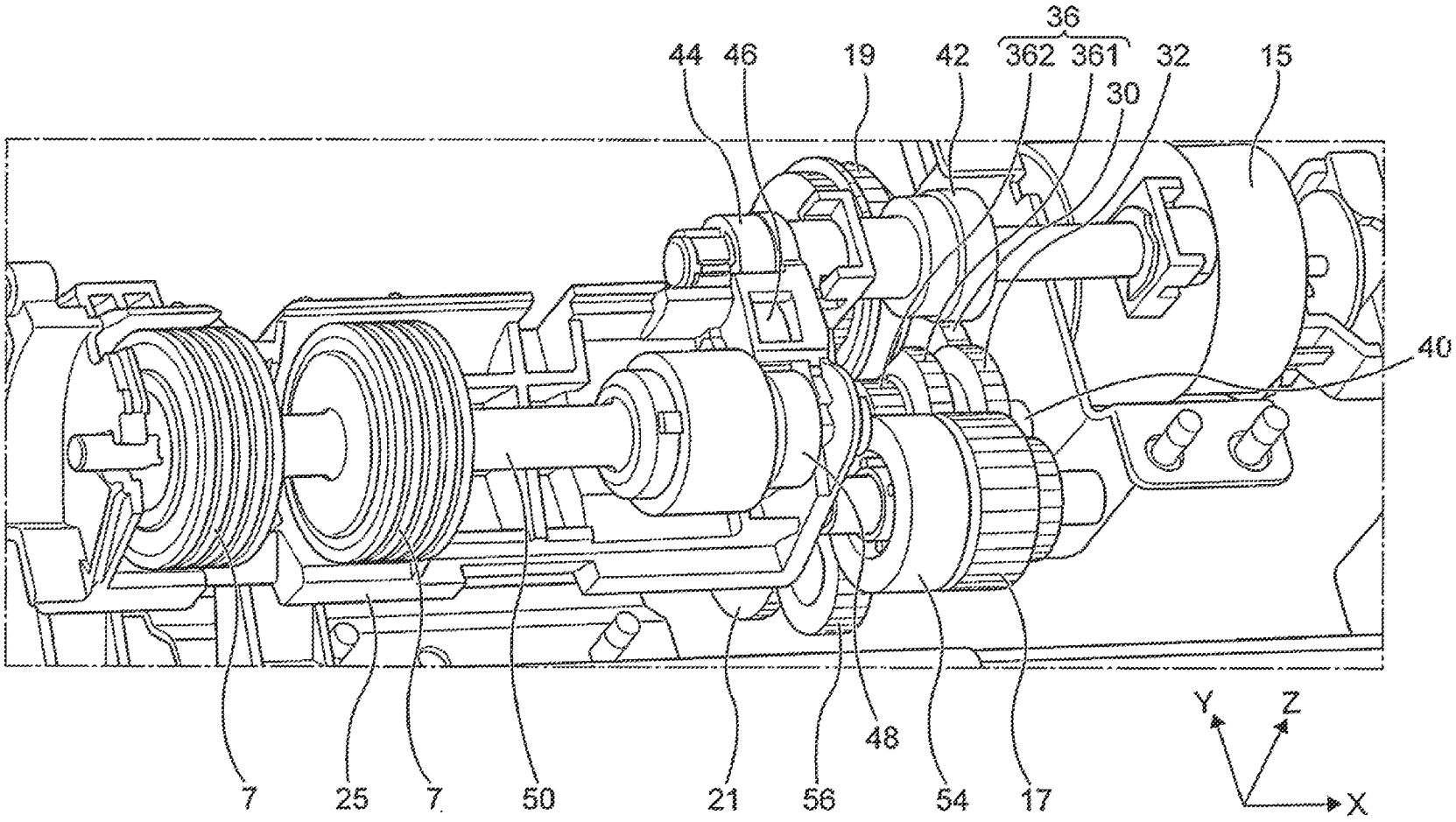
FIG. 4 is a perspective view illustrating the main part of the power transmission path according to the first embodiment when viewed in a different direction.

The power transmission path from the drive source 15 to the separation roller 7 will be described with reference to FIGS. 2 to 4. Power of a motor serving as the drive source 15, that is, a torque, is sequentially transmitted from a motor pinion 28 to a first gear 30, a second gear 32, a third gear 34, and a fourth gear 36. The first gear 30, the second gear 32, the third gear 34, and the fourth gear 36 are formed using stepped gears each including a large-diameter gear that receives the power and a small-diameter gear that transmits the power to the next gear. The first gear 30 and the third gear 34 are attached to a shaft 38. The second gear 32 and the fourth gear 36 are attached to a shaft 40. The fourth gear 36 includes a large-diameter gear 361 and a small-diameter gear 362. The large-diameter gear 361 also meshes with a one-way clutch 17 and transmits power to the one-way clutch 17. Meanwhile, the small-diameter gear 362 meshes with a connection gear 19 and transmits power to the connection gear 19. The connection gear 19 meshes with a fifth gear 42 and transmits power to the fifth gear 42. The fifth gear 42 has a transmission gear 44 (FIG. 4) that rotates together. As illustrated in FIG. 4, the transmission gear 44 transmits power to a seventh gear 48 (FIG. 4) via a sixth gear 46. The seventh gear 48 is fixed to a shaft 50 to which the separation roller 7 is fixed in such a way as to rotate together. When the power of the drive source 15 is transmitted to the seventh gear 48 through the above-described transmissions, the shaft 50 rotates, and the separation roller 7 rotates accordingly.

Power Transmission Path from Drive Source to Pressing Force Change Portion

The power transmission path from the drive source 15 to the pressing force change portion 13 will be described with reference to FIGS. 2 to 4. A power transmission path from the drive source 15 to the one-way clutch 17 is as described above. The one-way clutch 17 idles when the drive source 15 rotates forward, that is, when transmitting the power to rotate the separation roller 7 in the second rotation direction R2, and no power is transmitted to a coaxially positioned transmission gear 54. That is, no power is transmitted downstream from the one-way clutch 17 in a power transmission direction due to the idling of the one-way clutch 17. On the other hand, when the drive source 15 rotates in reverse, the one-way clutch 17 and the transmission gear 54 mesh with each other and rotate together. The transmission gear 54 meshes with an eighth gear 56 and transmits power to the eighth gear 56. The eighth gear 56 meshes with a power transmitted gear 21 included in the pressing force change portion 13 and transmits power to the power transmitted gear 21. Next, a configuration of the pressing force change portion 13 will be described.

Pressing Force Change Portion

Figure 5:
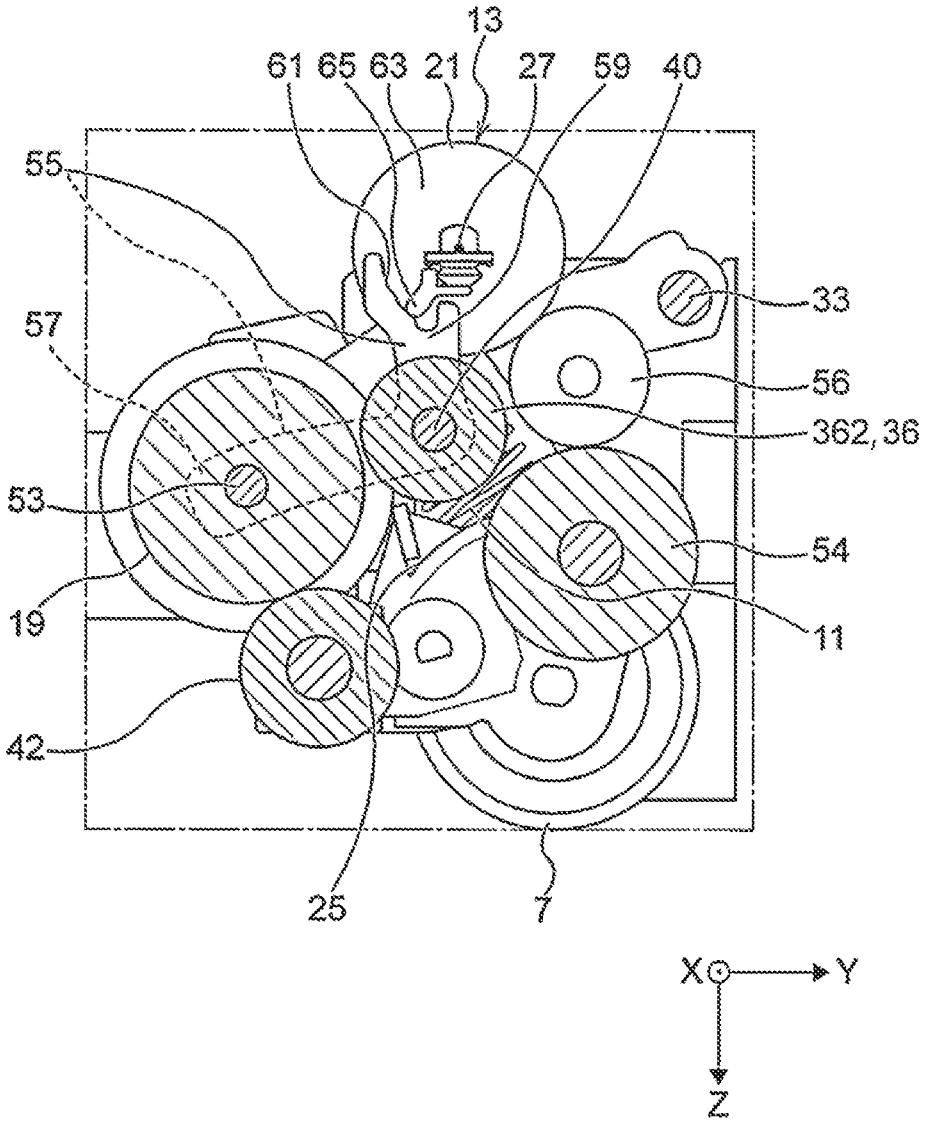
FIG. 5 is a side cross-sectional view illustrating the main part of the power transmission path according to the first embodiment.
Figure 6:
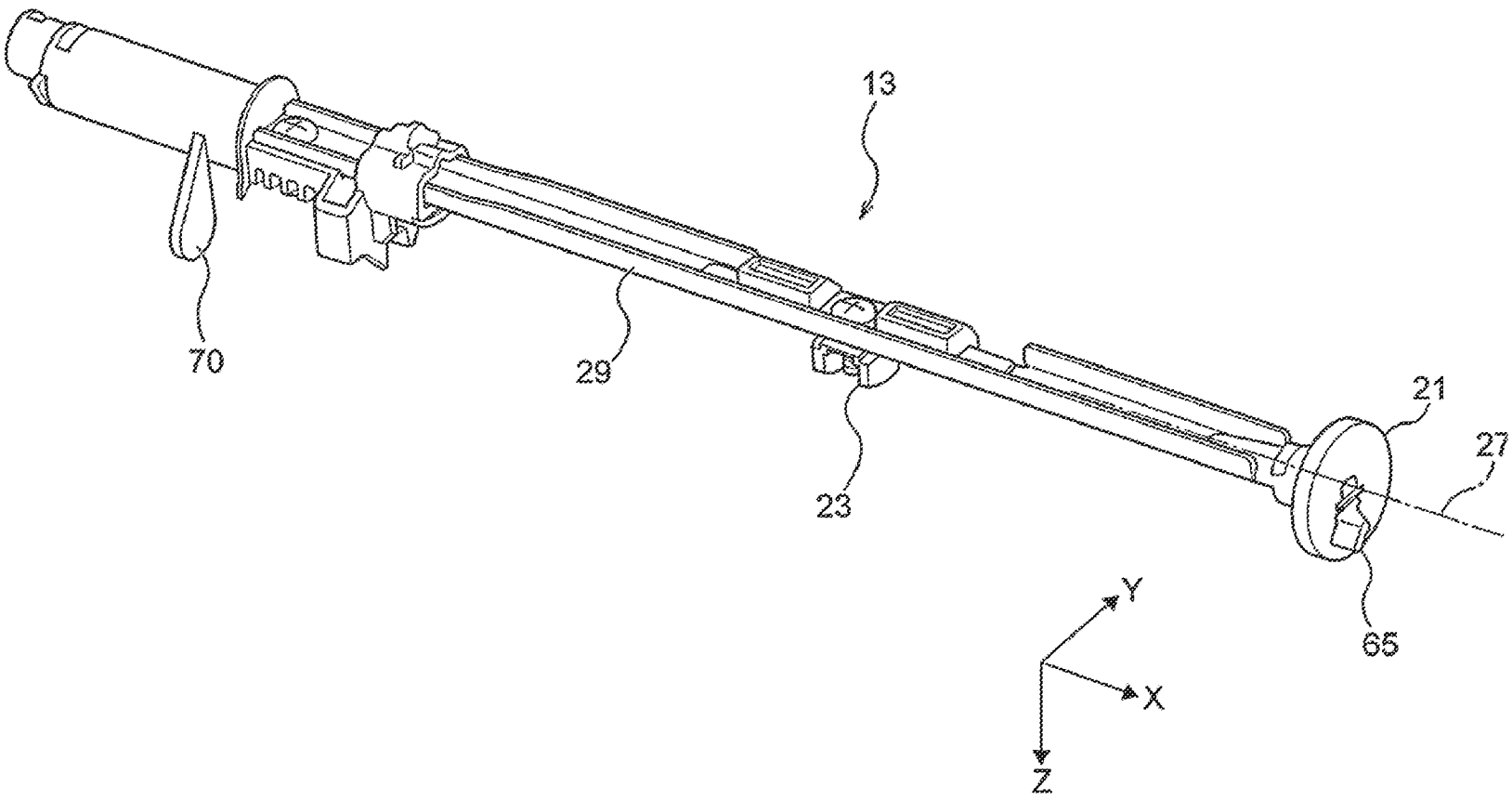
FIG. 6 is a perspective view illustrating a pressing force change portion according to the first embodiment.

As illustrated in FIGS. 5 to 8C, the pressing force change portion 13 includes a pressing portion 23 that presses the pressing member 11. Here, the pressing member 11 is implemented by a coil spring, and one end of the pressing member 11 is coupled to and held by a holder 25 that holds the separation roller 7. In the present embodiment, as illustrated in FIG. 6, the pressing force change portion 13 includes an elongated body 29 that includes the pressing portion 23 and is rotatable around an axis 27, the power transmitted gear 21 (FIGS. 5 and 6) which is fixed to the elongated body 29 and to which the power of the drive source 15 is transmitted, and a base portion 31 that holds a base end of the pressing member 11 with a base end holding portion 47 and is displaceable in a direction of the pressing force P. The base portion 31 changes a pressing load L that presses the pressing member 11 by being displaced by the torque of the drive source 15 transmitted via the power transmitted gear 21, the elongated body 29, and the pressing portion 23. The pressing force P of the pressing member 11 can be changed by changing the pressing load L.

Figure 7:
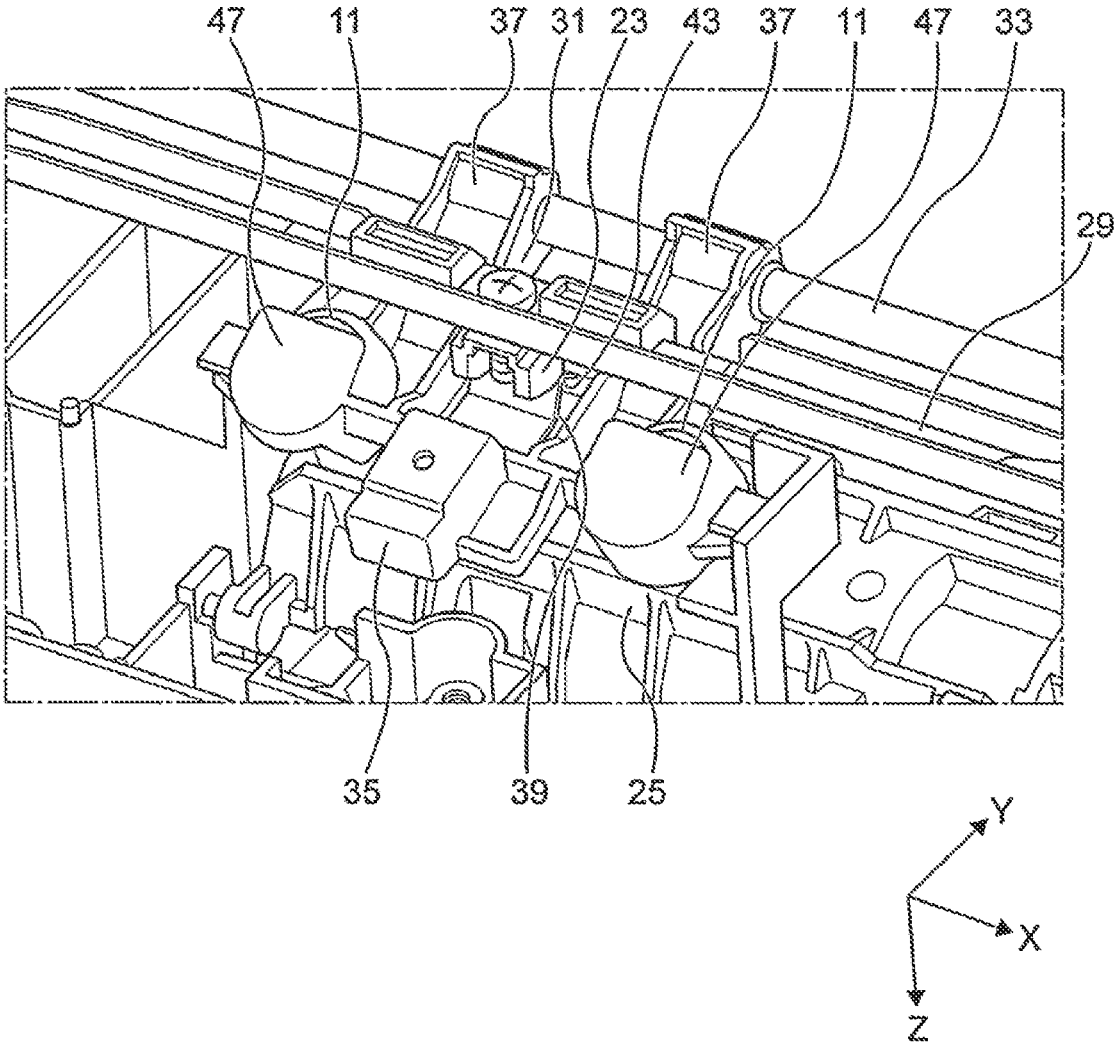
FIG. 7 is a perspective view illustrating a main part of the pressing force change portion according to the first embodiment.
Figure 8A:
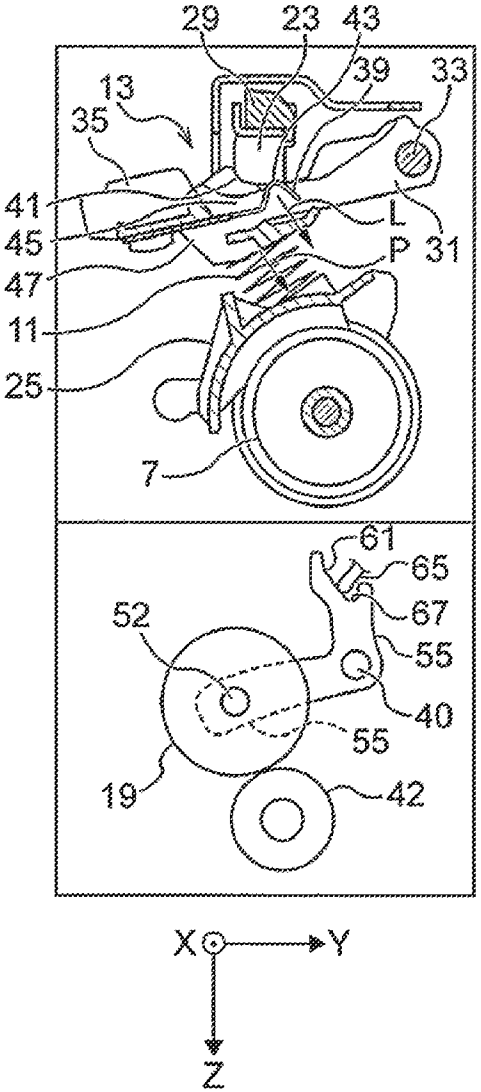
FIGS. 8A to 8C are views for describing an operation of the pressing force change portion according to the first embodiment.
Figure 8B:
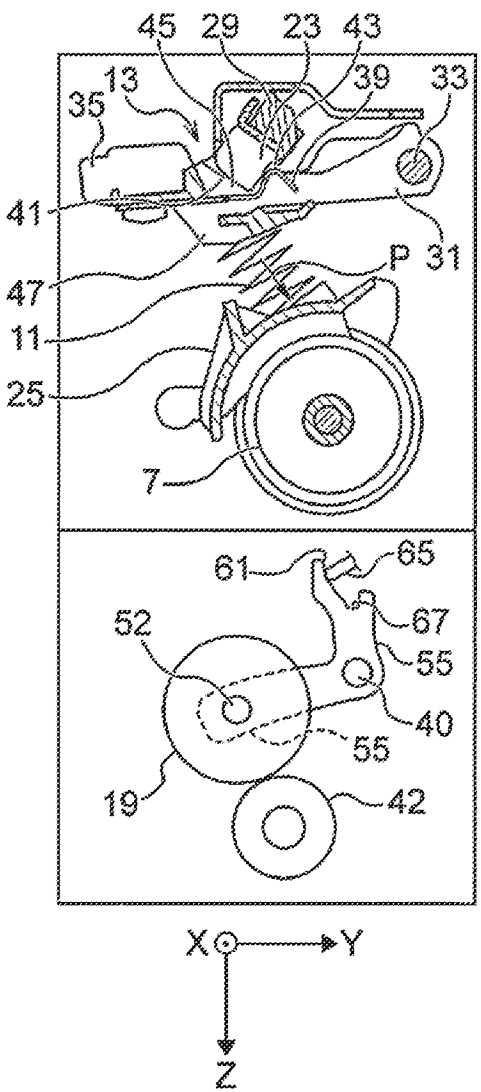
Figure 8C:
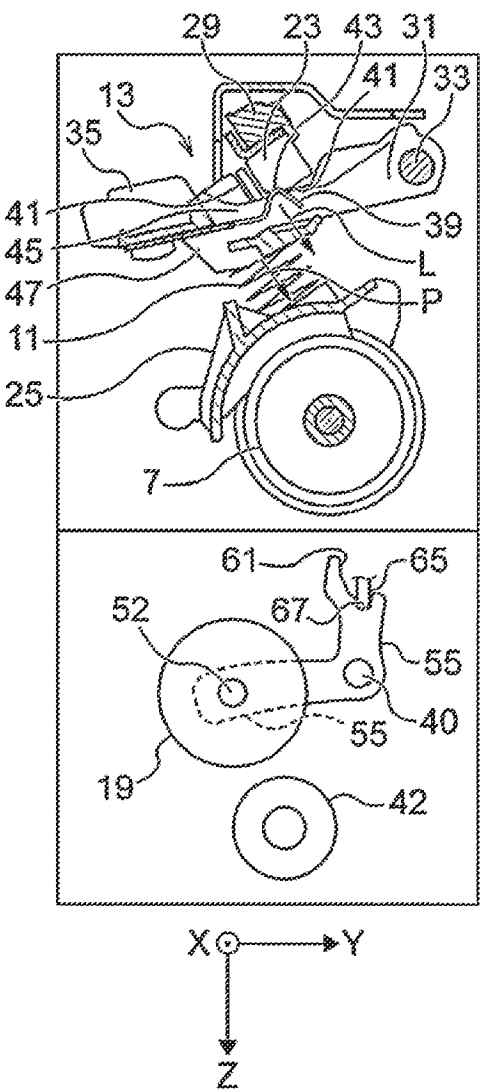

As illustrated in FIGS. 7 to 8C, the base portion 31 is provided with a free end 35 rotatably provided on a rotation shaft 33 using the rotation shaft 33 as a rotation fulcrum. The rotation shaft 33 is attached to a main body frame of the medium transport device 9 and extends in the X-axis direction. The base portion 31 has a base end 37 attached to the rotation shaft 33. A leaf spring 39 is fixed to the base portion 31. The pressing load L is generated in an elastically balanced state by pressing in a state in which a pressing surface 41 of the pressing portion 23 is in contact with a pressing point 43 of the leaf spring 39 as illustrated in FIGS. 8A and 8C. On the other hand, since an elastic force of the leaf spring 39 is not applied in a state in which the pressing surface 41 of the pressing portion 23 is separated from the pressing point 43 of the leaf spring 39 and is in contact with an upper surface 45 of the base portion 31 as illustrated in FIG. 8B, the pressing load L decreases.

In the present embodiment, the separation roller 7 is configured to be switchable between a driving force transmission state in which the driving force is transmitted from the drive source 15 and a driving force non-transmission state in which the driving force is not transmitted. The states illustrated in FIGS. 5, 8A, and 8B correspond to the driving force transmission state. The state illustrated in FIG. 8C corresponds to the driving force non-transmission state. The driving force transmission state of the separation roller 7 is switched to the driving force non-transmission state when the drive source 15 rotates in reverse, which will be described in detail.

In the present embodiment, a shaft 53 of the connection gear 19 is attached to one end 57 of an L-shaped swing arm 55 as illustrated in FIG. 5. FIGS. 5, 8A, and 8B illustrate a state in which the connection gear 19 meshes with the fifth gear 42, that is, the driving force transmission state. The swing arm 55 is attached to the shaft 40 of the fourth gear 36. The shaft 40 serves as a swing fulcrum when the swing arm 55 swings. A cam follower 61 is formed at the other end 59 of the L-shaped swing arm 55. Meanwhile, a cam 65 protrudes from a side surface 63 of the power transmitted gear 21 of the pressing force change portion 13. When the power transmitted gear 21 receives power from the drive source 15 rotating in reverse and rotates clockwise around the axis 27, the cam 65 moves in the same direction, that is, in a clockwise circumferential direction. As the cam 65 moves in the circumferential direction, a position where the cam 65 comes into contact with the cam follower 61 changes as illustrated in FIGS. 8A to 8C. That is, when the cam 65 moves in the circumferential direction, the position where the cam 65 comes into contact with the cam follower 61 moves. As a result, the power from the drive source 15 is transmitted to the swing arm 55 via the cam follower 61, and the swing arm 55 swings around the shaft 40 serving as the swing fulcrum. As the swing arm 55 swings, switching to a state in which the connection gear 19 is separated from the fifth gear 42 (as illustrated in FIG. 8C), that is, the driving force non-transmission state, is made, which will be described in more detail below.

In the present embodiment, a thickness detection unit 49 that detects a thickness of the medium 3 and a control unit 71 are provided as illustrated in FIG. 1. Here, the thickness detection unit 49 is arranged downstream of the feeding roller 10 in the transport direction F. However, the thickness detection unit 49 may also be provided upstream of the feeding roller 10. The thickness detection unit 49 is capable of distinguishing the type of the medium 3, such as plain paper, thick paper, thin paper, or the like, based on a medium thickness detection result. Here, an ultrasonic sensor is used as the thickness detection unit 49, and it is also possible to detect the multi-feed state in which a plurality of media 3 are fed. The thickness detection unit 49 only needs to be able to detect the thickness of the medium 3, and may be an optical sensor. The control unit 71 is configured to drive the pressing force change portion 13 to change the pressing force P of the pressing member 11 based on the detection result of the thickness detection unit 49. In other words, the control unit 71 is configured to be able to automatically switch a medium separation mode of the separation roller 7 based on the detection result of the thickness detection unit 49. The automatic switching will be described in more detail below.

Here, the control unit 71 is configured to cause the feeding roller 10 to feed the medium 3 to transport the medium 3 to a detection position where the thickness detection unit 49 can detect the thickness of the medium 3, and cause the thickness detection unit 49 to detect the thickness of the medium 3 at the detection position. Further, the control unit 71 may be configured to cause the feeding roller 10 to feed the medium 3, transport the medium 3 to the detection position where the thickness detection unit 49 can detect the thickness of the medium 3, and cause the thickness detection unit 49 to detect the thickness of the medium 3 in a state in which the medium 3 is stopped at the detection position. The control unit 71 includes a central processing unit (CPU), a flash read only memory (ROM), and a random access memory (RAM). The CPU executes various arithmetic operations according to a program stored in the flash ROM and controls the overall operation of the image reading device 1. The flash ROM that is an example of a storage unit is a readable and writable nonvolatile memory. The RAM that is an example of the storage unit temporarily stores various types of information.

Modification

When a plurality of media 3 including a preceding medium and a succeeding medium are transported through the transport path 2, the pressing force P of the pressing force change portion 13 for the succeeding medium may be changed based on the thickness of the preceding medium detected by the thickness detection unit 49. Transport errors such as jams are likely to occur due to curling or bending of a leading edge of the succeeding medium. With this configuration, the pressing force P for the succeeding medium is changed according to the thickness of the preceding medium, and thus, separation can be performed more appropriately. The state of the pressing force change portion 13 may return to a normal mode after one job of image reading is completed.

Description of Operation of First Embodiment

Switching of Separation Mode of Separation Roller

FIG. 8A illustrates a state corresponding to a normal separation mode, and FIG. 8B illustrates a state corresponding to a thin medium separation mode. Here, the normal separation mode is a mode in which the medium 3 that is called so-called plain paper or thick paper can be appropriately separated by the separation roller 7. The thin medium separation mode is a mode in which the medium 3 that is called thin paper thinner than plain paper can be separated by the separation roller 7 while reducing the possibility of paper jams or the like. In both the normal separation mode and the thin medium separation mode, when transport of the medium 3 starts from the medium mounting section 14 by the pick roller 12, and a single medium 3 is separated by the separation roller 7 and transported in the transport direction F, the drive source 15 rotates forward.

Switching from Normal Separation Mode to Thin Medium Separation Mode

When switching from the normal separation mode to the thin medium separation mode, the drive source 15 rotates in reverse instead of forward. The power from the drive source 15 rotating in reverse is transmitted to the one-way clutch 17 via the above-described power transmission path, and when the drive source 15 rotates in reverse, the power is further transmitted to the transmission gear 54 and is transmitted to the power transmitted gear 21 included in the pressing force change portion 13 via the eighth gear 56 (FIG. 3). As a result, the pressing force change portion 13 is driven, and the pressing portion 23 rotates in such a way as to change the position thereof from the position illustrated in FIG. 8A to the position illustrated in FIG. 8B. In this state, the reverse rotation of the drive source 15 is stopped under the control of the control unit 71. When the pressing portion 23 is in this state, the pressing surface 41 of the pressing portion 23 is separated from the pressing point 43 of the leaf spring 39, and the free end 35 of the base portion 31 rotates in the −Z direction around the rotation shaft 33 as the rotation fulcrum by an elastic reaction force of the pressing member 11 in a compressed state. In other words, the base portion 31 is displaced in the direction of the pressing force P of the pressing member 11 and in a direction away from the separation roller 7. Then, when the pressing surface 41 of the pressing portion 23 comes into contact with the upper surface 45 of the base portion 31, the base portion 31 stops rotating in the −Z direction. As the base portion 31 rotates in the −Z direction, the pressing load L pressing the pressing member 11 becomes smaller than that in the normal separation mode. Accordingly, the pressing member 11 in the compressed state can extend its entire length, and as a result, the pressing force P becomes smaller, and a change to the state corresponding to the thin medium separation mode is made.

By rotating the drive source 15 forward in this state, the medium 3 is separated in the thin medium separation mode. The power from the drive source 15 rotating forward is transmitted to the one-way clutch 17 and is not transmitted to the pressing force change portion 13, as a result of which the thin medium separation mode, that is, the state in which the pressing portion 23 and the base portion 31 are in contact with each other as illustrated in FIG. 8B, is maintained. Therefore, it is possible to cause the separation roller 7 to perform a separation operation with a pressing force P suitable for thin paper.

Switching from Thin Medium Separation Mode to Normal Separation Mode

When performing switching from the thin medium separation mode to the normal separation mode, the drive source 15 is rotated in reverse to rotate the elongated body 29 around the axis 27 via the power transmitted gear 21 and further rotate the pressing portion 23 clockwise from the position illustrated in FIG. 8B. Then, the pressing portion 23 is rotated to the position illustrated in FIG. 8A and stopped. In this state, the pressing surface 41 of the pressing portion 23 is in contact with the pressing point 43 of the leaf spring 39, and the free end 35 of the base portion 31 rotates upward around the rotation shaft 33 as the rotation fulcrum. In other words, the base portion 31 is displaced in the direction of the pressing force P of the pressing member 11 and in a direction toward the separation roller 7. As a result, switching to the normal separation mode in which the pressing load L is larger than that in the thin medium separation mode due to the applied elastic force of the leaf spring 39 is made.

Switching from Driving Force Transmission State to Driving Force Non-Transmission State Positional relationships among the swing arm 55, the cam 65, the cam follower 61, the connection gear 19, and the fifth gear 42 are schematically illustrated on the lower sides of FIGS. 8A, 8B, and 8C. When the power transmitted gear 21 rotates, the pressing portion 23 rotates around the axis 27 and the cam 65 also moves in the circumferential direction. Therefore, a position of the pressing portion 23 and a position of the cam 65 correspond to each other in each of FIGS. 8A, 8B, and 8C. In the following description, when a position where the cam 65 comes into contact with the cam follower 61 is as illustrated in FIG. 8A, the position is referred to as Position 1. When the position where the cam 65 comes into contact with the cam follower 61 is as illustrated in FIG. 8B, the position is referred to as Position 2. When the position where the cam 65 comes into contact with the cam follower 61 is as illustrated in FIG. 8C, the position is referred to as Position 3.

A state in which the cam 65 is at Position 1 corresponds to the normal separation mode. A state in which the cam 65 is at Position 2 corresponds to the thin medium separation mode. When the cam 65 is at Position 1 or Position 2, that is, when the cam 65 is not positioned at a top portion 67 of the cam follower 61, the swing arm 55 rotates to a position where a state in which the connection gear 19 and the fifth gear 42 mesh with each other can be maintained as illustrated in FIGS. 8A and 8B. As the power transmitted gear 21 rotates, the cam 65 moves further in the clockwise circumferential direction from Position 2, and when the cam 65 completes almost one full rotation, the cam 65 moves to Position 3. At Position 3, the cam 65 comes into contact with the top portion 67 of the cam follower 61 as illustrated in FIG. 8C. As a result, the swing arm 55 swings clockwise around the shaft 40 as a swing center. As the swing arm 55 swings as described above, the connection gear 19 is separated from the fifth gear 42, and switching from the driving force transmission state to the driving force non-transmission state is made.

The driving force non-transmission state is used when the user inserts the media 3 one by one into the transport path 2 to feed the medium 3 in the transport direction by the feeding roller 10 or the transport roller 4, without the need for separation by the separation roller 7. Such a case is often referred to as a so-called "manual feeding mode", and thus, the term will be used here. The manual feeding mode is often used when transporting a medium called super thick paper or a medium called brittle paper. When the drive source 15 is slightly rotated in the manual feeding mode (FIG. 8C), the cam 65 moves from Position 3 to Position 1, and a change to the state corresponding to the normal separation mode illustrated in FIG. 8A is made.

Sensing of Position 1, Position 2, and Position 3

According to the present embodiment, it is possible to sense whether the cam 65 is positioned at Position 1, Position 2, or Position 3. As illustrated in FIGS. 6 to 9B, a first sensor 66 and a second sensor 68 each including a pair of a light emitting portion and a light receiving portion are installed on the main body frame of the medium transport device 9 at a predetermined interval in the Y-axis direction. A light shielding piece 70 is provided on the elongated body 29. A behavior of the light shielding piece 70 with respect to the first sensor 66 and the second sensor 68 is controlled by the control unit 71.

Figure 9A:
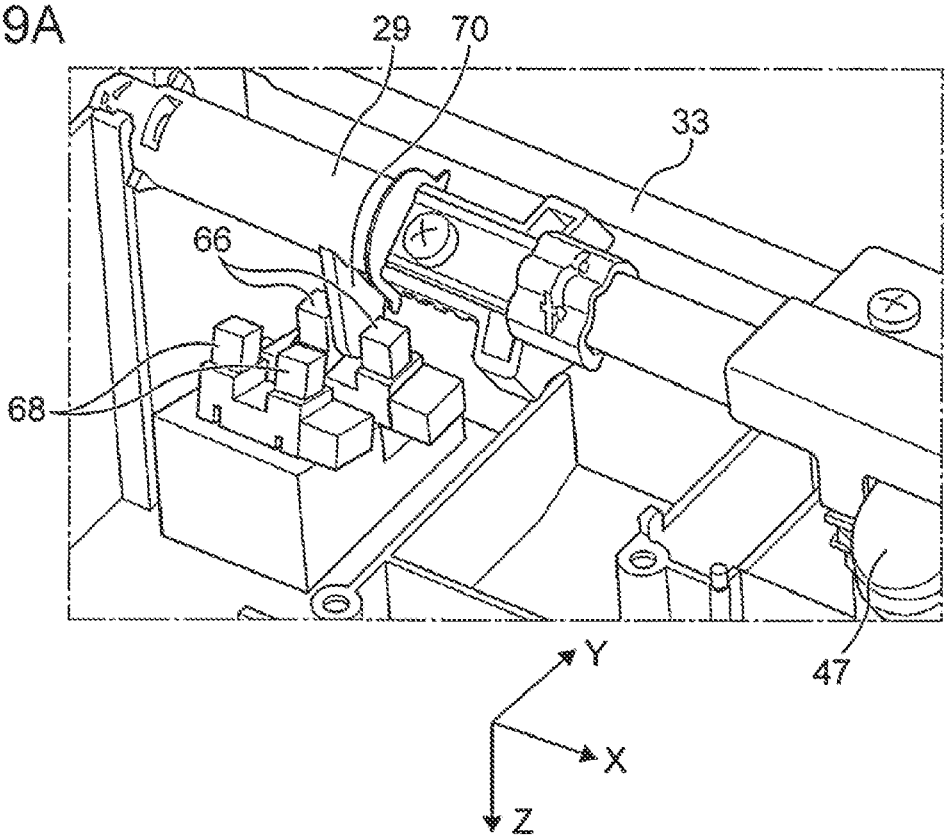
FIGS. 9A and 9B are perspective views illustrating a main part of a sensor portion that senses a position of a cam according to the first embodiment.
Figure 9B:
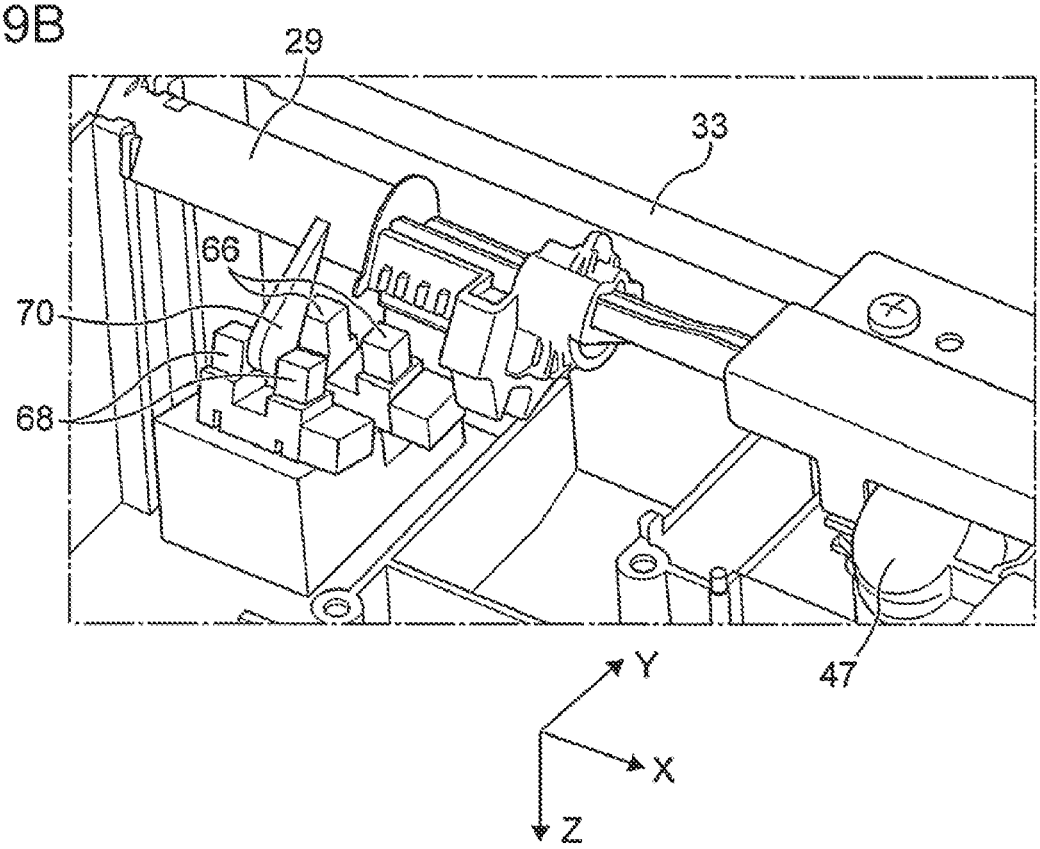

As illustrated in FIG. 9A, when the light shielding piece 70 is positioned in an optical path of the first sensor 66, the control unit 71 determines that the cam 65 is positioned at Position 3, that is, the manual feeding mode is set. As illustrated in FIG. 9B, when the light shielding piece 70 is positioned in an optical path of the second sensor 68, the control unit 71 determines that the cam 65 is positioned at Position 2, that is, the thin medium separation mode is set. When the light shielding piece 70 is positioned at a portion corresponding to the predetermined interval between the first sensor 66 and the second sensor 68, the control unit 71 determines that the cam 65 is at Position 1, that is, the normal separation mode is set. It is a matter of course that the structure of the sensor that senses whether the cam 65 is positioned at Position 1, Position 2, or Position 3 is not limited to the above structure.

A personal computer (PC) and the image reading device 1 are coupled to each other, and there is a type of image reading device 1 of which reading operation is set and performed by inputting information such as "the type of the medium" or "double-sided reading" while viewing a settings screen of the PC. According to the present embodiment, in this type of image reading device 1, when the control unit 71 receives information indicating "thin paper" as the detection result of the thickness detection unit 49, the control unit 71 determines the "thin medium separation mode" as a medium separation mode to be applied. Furthermore, the control unit 71 transports the medium in the "thin medium separation mode" and transmits the determination result, that is, the determination result indicating the "thin medium separation mode", to the PC. As a result, user-friendliness can be improved by displaying a message such as "Currently in thin medium separation mode" on the setting screen of the PC.

Figure 10:
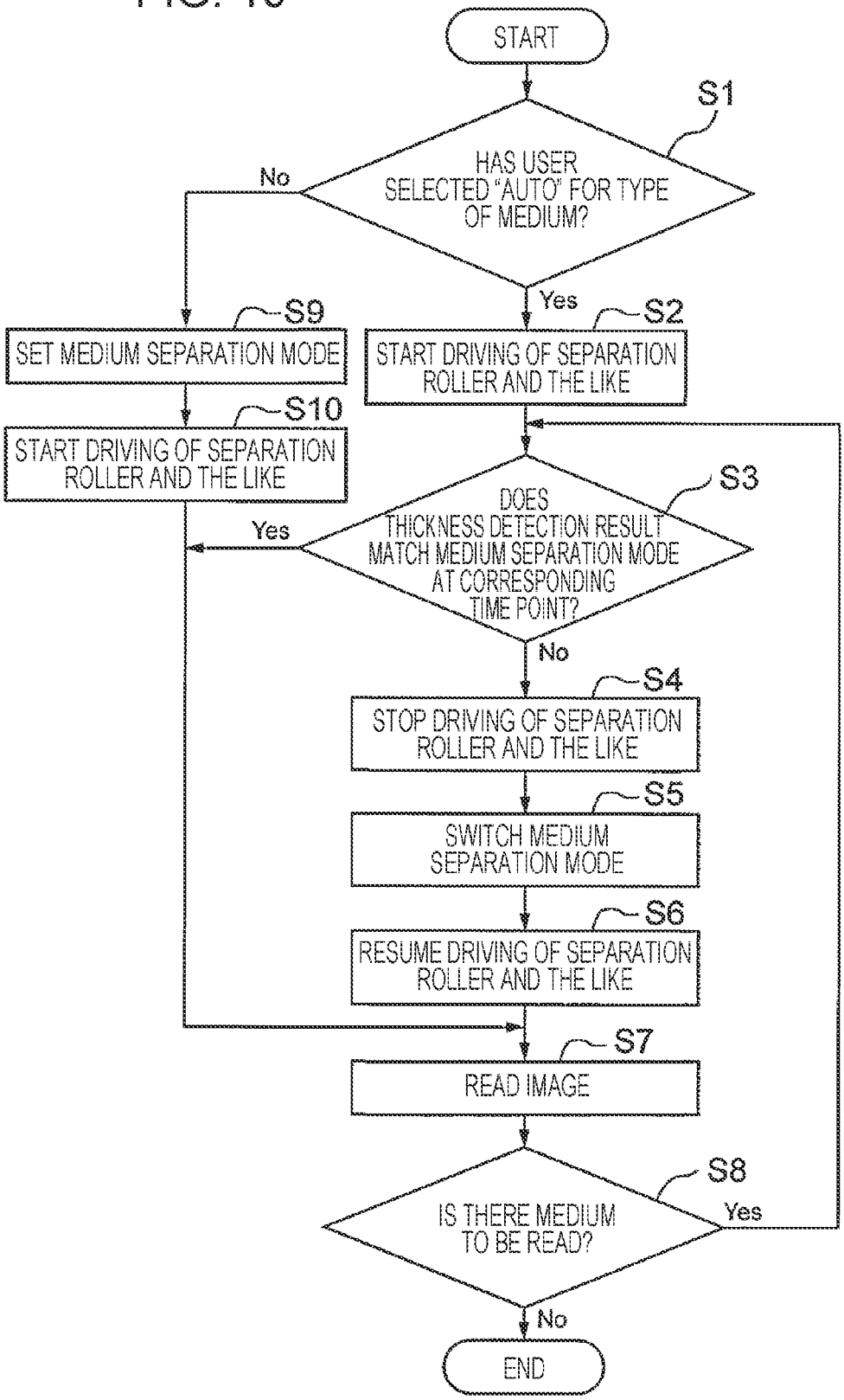
FIG. 10 is a flowchart for describing automation of switching of a medium separation mode according to the first embodiment.

Automation of Switching of Medium Separation Mode Using Thickness Detection Unit An example of a control procedure for a configuration in which the control unit 71 automates switching of the medium separation mode using the thickness detection unit 49 will be described with reference to the flowchart in FIG. 10. First, in step S1, it is determined whether or not the user has selected "auto" in specifying the type of the medium 3, that is, the type such as thick paper, plain paper, or thin paper, while viewing the setting screen of the PC. When "auto" is selected, the image reading device 1 automatically determines the type of the medium 3. When an affirmative determination (Yes) is made, the processing proceeds to step S2, and the separation roller 7, the feeding roller 10, the pick roller 12, and the like are driven to start transporting the medium 3. When the leading edge of the transported medium 3 reaches the detection position for the thickness detection unit 49, the thickness of the medium 3 is detected, and in step S3, it is determined whether or not the detection result matches the current medium separation mode. When a negative determination (No) is made in step S3, the processing proceeds to step S4. In step S4, the driving of the separation roller 7 and the like is stopped, and the transport is stopped. Subsequently, in step S5, the medium separation mode is switched to a medium separation mode suitable for the type of the medium 3. Then, the processing proceeds to step S6. When an affirmative determination (Yes) is made in step S3, it is determined that the medium separation mode at the corresponding time point is suitable for the type of the medium 3, and the processing proceeds to step S7. In step S6, the separation roller 7 and the like are driven to resume the transport of the medium 3. When a negative determination (No) is made in step S1, the processing proceeds to step S9. In step S9, the medium separation mode suitable for the type of the medium 3 selected by the user is set. Next, the processing proceeds to S10, and the separation roller 7 and the like are driven to start transporting the medium 3, and the processing proceeds to step S7. Next, in step S7, image reading is performed by the reading portions 51 and 52. Subsequently, in step S8, it is determined whether or not there is a remaining medium 3 to be read, and when there is a remaining medium 3 to be read, that is, an affirmative determination (Yes) is made, the processing returns to step S2. On the other hand, when a negative determination (No) is made, the processing ends.

When the thickness detection unit 49 is configured to detect the thickness of the medium 3 in a state in which the leading edge of the transported medium 3 reaches the detection position for the thickness detection unit 49, and the medium 3 is stopped at the detection position, that is, in a state in which the driving of the separation roller 7 and the like is stopped, the processing after step S3 is as follows. When an affirmative determination (Yes) is made in step S3, the separation roller 7 and the like are driven to resume the transport of the medium 3, and the processing proceeds to step S7. When a negative determination (No) is made in step S3, the driving of the separation roller 7 and the like is stopped as in the state of step S4, and thus, the processing proceeds to step S5.

Modifications of Automation of Switching of Medium Separation Mode Using Thickness Detection Unit (1) In a case in which an affirmative determination (Yes) is made in step S8, when a mode in which a plurality of media 3 are read in one job is selected, the processing may return to step S7. When a plurality of media 3 are read in one job, the types of the plurality of media 3 are often the same. Therefore, the medium separation mode may be determined for only the first medium in the job, and the determination of the medium separation mode for the succeeding media 3 may be omitted. Thereby, a time required for reading can be shortened.

(2) The image reading device 1 may have a mixed mode in which a plurality of different types of media 3 are read in one job. In this case, switching to a medium separation mode suitable for each type of medium 3 may be made. Therefore, the medium separation mode may be determined for each medium 3.

(3) When a negative determination (No) is made in step S1, the processing may proceed to step S2. In other words, step S1 may be omitted. That is, the medium separation mode may be determined regardless of the selection of the type of the medium 3 by the user. Even when the user selects a wrong type of medium 3, the user can perform switching to a medium separation mode suitable for the type of the medium 3.

(4) These modifications may be combined with each other or with the embodiment as appropriate.

Description of Effects of First Embodiment (1) In the present embodiment, the pressing member 11 that presses the separation roller 7 against the feeding roller 10, the pressing force change portion 13 that changes the pressing force P of the pressing member 11, and the single drive source 15 that generates the driving force for the separation roller 7 and the driving force for the pressing force change portion 13 are provided. As a result, the driving forces for driving the separation roller 7 and the pressing force change portion 13 are transmitted by the common drive source 15, that is, only one drive source 15 is required, and thus, a reduction in the size of the device that transports the media 3 having different properties such as the thicknesses can be easily promoted.

(2) In the present embodiment, the pressing force change portion 13 changes the pressing force P of the pressing member 11 by changing the pressing load L with which the pressing portion 23 presses the pressing member 11. Thereby, the pressing force P of the pressing member 11 can be changed with a simple structure.

(3) In the present embodiment, the pressing force change portion 13 includes the base portion 31 that holds the base end of the pressing member 11 with the base end holding portion 47 and is displaceable in the direction of the pressing force P, and the base portion 31 changes the pressing load L that presses the pressing member 11 by being displaced by the torque of the drive source 15 transmitted via the power transmitted gear 21, the elongated body 29, and the pressing portion 23. Thereby, a change of the pressing load L by the pressing force change portion 13 can be implemented with a simple structure.

(4) In the present embodiment, the drive source 15 transmits, via the one-way clutch 17, the driving force for rotating the separation roller 7 in the second rotation direction R2 when rotating forward, and transmits the driving force for changing the pressing force P to the pressing force change portion 13 when rotating in reverse. Thereby, a state in which the driving force of the drive source 15 is transmitted to the pressing force change portion 13 can be easily implemented by switching the forward rotation of the drive source 15 to the reverse rotation. That is, the pressing force P of the pressing member 11 can be easily changed by simply switching the forward rotation of the drive source 15 to the reverse rotation. Furthermore, since the one-way clutch 17 is provided, when the rotation of the drive source 15 is changed to the forward rotation, the driving force is not transmitted to the pressing force change portion 13. That is, the state of the pressing force change portion 13 is maintained as it is, and therefore the changed pressing force P of the pressing member 11 is maintained.

(5) In the present embodiment, the driving force transmission state of the separation roller 7 is switched to the driving force non-transmission state when the drive source 15 rotates in reverse. Therefore, it is possible to use the separation roller 7 in a state in which the driving force is not transmitted, that is, in a state in which the driving force is not transmitted and the separation roller 7 is free to rotate. Specifically, it is possible to easily implement medium feeding in the so-called "manual feeding mode" in which the user feeds the media 3 one by one, that is, there is no need for separation processing.

(6) In the present embodiment, the control unit 71 drives the pressing force change portion 13 to change the pressing force P of the pressing member 11 based on the detection result of the thickness detection unit 49. Therefore, it is possible to automatically change the pressing force P of the pressing member 11 according to the thickness of the medium 3.

(7) In the present embodiment, the control unit 71 is configured to cause the feeding roller 10 to transport the medium 3 to the thickness detection position for the thickness detection unit 49, and cause the thickness detection unit 49 to detect the thickness of the medium 3 in a state in which the medium 3 is stopped at the detection position. In this case, it is possible to detect the thickness of the medium 3 with higher accuracy.

Second Embodiment

Next, a medium transport device 9 according to a second embodiment will be described. The same portions as those in the first embodiment are denoted by the same reference numerals, and a description of the configurations and corresponding effects will be omitted. A control unit 71 is configured to drive a pressing force change portion 13 to change a pressing load L as in the first embodiment, thereby changing a pressing force P of a pressing member 11, that is, changing a medium separation mode. In the present embodiment, the control unit 71 is configured to change the pressing force P of the pressing member 11 and further change a rotation speed of a separation roller 7.

Specifically, a rotation speed of the motor can be changed by increasing or decreasing a current for rotating a motor serving as a drive source 15, so that the rotation speed of the separation roller 7 can be changed. In the present embodiment, the rotation speed of the separation roller 7 is set to 26 mm/s in a normal separation mode, and the rotation speed of the separation roller 7 is set to 13 mm/s in a thin medium separation mode. These rotation speeds are examples. In the present embodiment, the control unit 71 is configured to be able to execute a strong separation mode for separating pressure-sensitive paper or used paper. In the strong separation mode, the pressing force change portion 13 is in the thin medium separation mode, and the rotation speed of the separation roller 7 is set to, for example, 52 mm/s. By increasing the rotation speed in this way, an ability to separate the medium 3 can be improved even when the pressing force P of the pressing member 11 remains the same.

Third Embodiment

Next, a medium transport device 9 according to a third embodiment will be described. The same portions as those in the first embodiment are denoted by the same reference numerals, and a description of the configurations and corresponding effects will be omitted. In the present embodiment, a control unit 71 is configured to receive information regarding a medium 3 from the user.

Specifically, the control unit 71 is configured to receive information regarding a type, a thickness, or the like of the medium 3 when the user inputs the information while viewing the setting screen of the PC. The control unit 71 is configured to drive a pressing force change portion 13 to change the pressing force of the pressing member, that is, to change a medium separation mode, based on the information regarding the medium 3. According to the present embodiment, it is not necessary to use the detection result of the thickness detection unit 49 of the first embodiment, and thus, the thickness detection unit 49 can be omitted. The user may select one of control that uses the detection result of the thickness detection unit 49 and control of the third embodiment that does not use the detection result of the thickness detection unit 49, and the selected control may be executed.

OTHER EMBODIMENTS

Although the medium transport device 9 and the image reading device 1 including the medium transport device 9 according to the present disclosure basically have the above-described configuration, it is a matter of course that partial modification or omission of the configuration can be made without departing from the gist of the present disclosure. In the above-described embodiments, a structure in which the connection gear 19 is arranged on the power transmission path through which the driving force is transmitted from the drive source 15 to the separation roller 7, and switching between the power transmission state and the power non-transmission state is performed by swinging the swing arm 55 has been described. A one-way clutch may be provided in place of the connection gear 19 that swings to perform switching between the power transmission state and the power non-transmission state. Furthermore, the switching from the driving force transmission state to the driving force non-transmission state may be performed by a motor separate from the drive source 15.

What is claimed is:

1. A medium transport device comprising:

a feeding roller that feeds a medium mounted on a medium mounting section;

a separation roller that nips the medium with the feeding roller to separate the medium and is configured to rotate in a first rotation direction in which the medium is transported downstream in a transport direction and a second rotation direction that is opposite to the first rotation direction;

a pressing member that generates a pressing force for pressing the separation roller against the feeding roller;

a pressing force change portion that changes the pressing force of the pressing member;

a single drive source that generates a driving force for the separation roller and a driving force for the pressing force change portion; and a control unit that drives the pressing force change portion to change the pressing force of the pressing member, wherein the control unit changes the pressing force of the pressing member and changes a rotation speed of the separation roller.

2. The medium transport device according to claim 1, wherein the pressing force change portion includes a pressing portion that presses the pressing member, and changes a pressing load with which the pressing portion presses the pressing member to change the pressing force of the pressing member.

3. The medium transport device according to claim 2, wherein the pressing force change portion includes an elongated body that includes the pressing portion and is configured to rotate around an axis, a power transmitted gear which is fixed to the elongated body and to which power of the drive source is transmitted, and a base portion that holds a base end of the pressing member and is configured to be displaced in a direction of the pressing force, and the base portion changes the pressing load by being displaced by a torque of the drive source transmitted via the power transmitted gear, the elongated body, and the pressing portion.

4. The medium transport device according to claim 1, wherein a one-way clutch is provided on a transmission path through which the driving force is transmitted from the drive source to the pressing force change portion, and the drive source transmits, via the one-way clutch, the driving force for rotating the separation roller in the second rotation direction when rotating forward, and transmits the driving force for changing the pressing force to the pressing force change portion when rotating in reverse.

5. The medium transport device according to claim 4, wherein the separation roller is configured to perform switching between a driving force transmission state in which the driving force is transmitted from the drive source, and a driving force non-transmission state in which the driving force is not transmitted, and the driving force transmission state of the separation roller is switched to the driving force non-transmission state when the drive source rotates in reverse.

6. The medium transport device according to claim 1, further comprising:

a thickness detection unit that detects a thickness of the medium, wherein the control unit drives the pressing force change portion to change the pressing force of the pressing member based on a detection result of the thickness detection unit.

7. The medium transport device according to claim 6, wherein the thickness detection unit is provided downstream of the feeding roller in the transport direction, and the control unit causes the feeding roller to feed the medium to transport the medium to a detection position where the thickness of the medium is detectable by the thickness detection unit, and causes the thickness detection unit to detect the thickness of the medium in a state in which the medium is stopped at the detection position.

8. The medium transport device according to claim 1, wherein the control unit receives information regarding the medium from a user, and wherein the control unit drives the pressing force change portion to change the pressing force of the pressing member based on the information regarding the medium.

9. An image reading device comprising:

the medium transport device according to claim 1; and a reading portion that reads an image on the medium.

10. A medium transport device comprising:

a feeding roller that feeds a medium mounted on a medium mounting section;

a separation roller that nips the medium with the feeding roller to separate the medium and is configured to rotate in a first rotation direction in which the medium is transported downstream in a transport direction and a second rotation direction that is opposite to the first rotation direction;

a pressing member that generates a pressing force for pressing the separation roller against the feeding roller;

a pressing force change portion that changes the pressing force of the pressing member; and a single drive source that generates a driving force for the separation roller and a driving force for the pressing force change portion, wherein a one-way clutch is provided on a transmission path through which the driving force is transmitted from the drive source to the pressing force change portion, and the drive source transmits, via the one-way clutch, the driving force for rotating the separation roller in the second rotation direction when rotating forward, and transmits the driving force for changing the pressing force to the pressing force change portion when rotating in reverse.

11. The medium transport device according to claim 10, wherein the separation roller is configured to perform switching between a driving force transmission state in which the driving force is transmitted from the drive source, and a driving force non-transmission state in which the driving force is not transmitted, and the driving force transmission state of the separation roller is switched to the driving force non-transmission state when the drive source rotates in reverse.

12. A medium transport device comprising:

a feeding roller that feeds a medium mounted on a medium mounting section;

a separation roller that nips the medium with the feeding roller to separate the medium and is configured to rotate in a first rotation direction in which the medium is transported downstream in a transport direction and a second rotation direction that is opposite to the first rotation direction;

a pressing member that generates a pressing force for pressing the separation roller against the feeding roller;

a pressing force change portion that changes the pressing force of the pressing member;

a single drive source that generates a driving force for the separation roller and a driving force for the pressing force change portion;

a thickness detection unit that detects a thickness of the medium; and a control unit, wherein the control unit drives the pressing force change portion to change the pressing force of the pressing member based on a detection result of the thickness detection unit.

13. The medium transport device according to claim 12, wherein the thickness detection unit is provided downstream of the feeding roller in the transport direction, and the control unit causes the feeding roller to feed the medium to transport the medium to a detection position where the thickness of the medium is detectable by the thickness detection unit, and causes the thickness detection unit to detect the thickness of the medium in a state in which the medium is stopped at the detection position.

* * * * *